United States Patent [19]

Katz

[11] 4,450,665

[45] May 29, 1984

[54] INTERLOCKING BUILDING SIDING

[75] Inventor: Harry Katz, Westerville, Ohio

[73] Assignee: Vinyl Improvement Products Company, Columbus, Ohio

[21] Appl. No.: 282,140

[22] Filed: Jul. 10, 1981

[51] Int. Cl.[3] ..... E04D 1/00

[52] U.S. Cl. ..... 52/522; 52/531; 52/546

[58] Field of Search ..... 52/522, 529, 531, 546, 52/520, 539

[56] References Cited

U.S. PATENT DOCUMENTS

| | | | |
|---|---|---|---|
| 1,589,675 | 6/1926 | Belding | 52/522 |
| 2,830,546 | 4/1958 | Rippe | 52/522 |
| 3,233,382 | 2/1966 | Graveley, Jr. | 52/522 |
| 3,289,365 | 12/1966 | McLaughlin et al. | 52/531 X |
| 3,325,952 | 6/1967 | Trachtenberg | 52/522 X |
| 3,399,916 | 9/1968 | Ensor | 52/522 X |
| 3,473,274 | 10/1969 | Godes | 52/531 X |
| 3,969,866 | 7/1976 | Kyne | 52/522 X |

*Primary Examiner*—Carl D. Friedman

*Attorney, Agent, or Firm*—Vorys, Sater, Seymour & Pease

[57] ABSTRACT

Elongated siding panels formed from plastic have integral joint portions along their side edges which are adapted to fit together and interlock when the panels are mounted on a building wall in overlapping relation. A flange adjacent the top edge of the panels extends outwardly and downwardly to define a channel open at its bottom, and an upwardly directed lip on the bottom edge of the panels is adapted to project into and interlock with the channel on a panel mounted therebelow on a building wall. A plurality of inwardly directed protrusions, or dimples, are formed on the upwardly directed lip to provide an interference fit with entrance to the channel.

3 Claims, 8 Drawing Figures

INTERLOCKING BUILDING SIDING

BACKGROUND OF THE INVENTION

1. Field of the Invention

This invention relates to plastic building siding material of the type used in surfacing exterior walls of buildings, and more particularly to improved plastic siding panels having integrally formed interlocking joint portions along the panel edges to facilitate mounting the siding on a building and to an improved method and apparatus for producing such siding material.

2. Description of the Prior Art

It is well known to use building siding panels formed of metal, typically aluminum, or of synthetic resin material (plastic) shaped for and adapted to be mounted on a wall to simulate weatherboarding. Such siding panels are conventionally formed with a plurality of elongated nailing slots adjacent their top edge for securing the individual panels to the building wall, and a downwardly directed open channel or clip adjacent the openings for nails which is adapted to engage and cooperate with an upwardly directed lip formed on the bottom edge of a second panel mounted thereabove to firmly retain the bottom edge of the second panel in position. This interlocking mounting, in cooperation with the elongated nail openings, permits substantial expansion movement of the respective siding panels and permits air passage, or breathing through the interlocking joints.

In forming such prior art siding panels from plastic materials such as polyvinyl chloride or the like by the extrusion process, substantial difficulty has been encountered in maintaining the dimensions of the various components within the necessary degree of tolerances so as to enable easy assembly of the panels one with the other while, at the same time, assuring the desired interference fit between the flange and the interlocking channel and lip. Various factors such as variations in temperature of the thermoplastic material being extruded, the age and quality of the plastic materials, and variation in the cooling rates of such materials, particularly where complex cross-sectional shapes are involved, can affect such tolerances. Differential cooling can also result in warping of the plastic material and such warping, particularly in the area of the interlocking channel and lip, can result in either an excessively loose or tight interlocking joint.

Various attempts have been made to provide an interlocking structure which will permit relative movement due to expansion and which will, at the same time, provide more positive interlocking engagement of the siding panels. For example, cooperating hook-shaped, or ratchet tooth elements have been integrally molded on the flange forming the channel and the cooperating lip. This arrangement has not been entirely satisfactory, however, since a substantial locking force is required to engage the ratchet teeth and failure of workman to properly engage the ratchet teeth can result. Further, it frequently occurs that a panel has to be removed, for example for recutting, before being finally nailed into position, and such interlocking ratchet teeth not only present difficulty in removing the panel, but also can be damaged during such removal.

SUMMARY OF THE INVENTION

It is a primary object of the present invention to provide an extruded plastic siding panel which includes improved interlocking clip means facilitating installation of the siding on a building wall.

Another object of the invention is to provide such a plastic siding panel which may be more easily and economically manufactured.

Another object is to provide such a plastic siding panel which may be manufactured utilizing greater tolerances while at the same time assuring positive interlocking fit of the joint elements.

Another object of the invention is to provide an improved method of manufacturing such plastic siding panels.

Another object is to provide an improved apparatus for use in the manufacture of such building siding panels.

In the attainment of the foregoing and other objects and advantages, an important feature of the invention resides in providing an extruded plastic siding panel having an integrally formed, downwardly directed locking flange adjacent its top edge, with the flange extending in outwardly spaced relation to the outer surface of the siding panel and being inclined toward the panel cooperating therewith to define a downwardly open channel having a restricted entrance portion adjacent its bottom open end. The bottom edge of the siding panel has an integrally formed, substantially horizontal ledge adapted to space the siding panel outward from the building wall at its bottom edge in a manner simulating weatherboarding, with the ledge terminating at its inner end and in upwardly directed lip adapted to be telescopingly received into the open channel on a second panel mounted therebelow. The upwardly directed lip terminates, at its upper edge portion, in a generally C-shaped bead which is easily inserted into a channel but dimensioned to present an interference fit in the restricted opening of the channel. Substantially greater interference with the locking flange on an adjacent panel is provided by dimples, or protrusions, formed in the area of the C-shaped bead at spaced intervals along its length. Such spacing of the dimples is important since by forming them at proper intervals, while the panels may be assembled easily, sufficient interference is provided to maintain the joint in an interlocking relationship without support by a workman before the panel is nailed into position. Furthermore, in such a dimple arrangement the panel may be repeatedly withdrawn and reinserted into the channel without damaging the structure.

The dimples are formed, in accordance with the present invention, by passing the extruded siding panels through a dimpling apparatus which includes guide means for accurately positioning the upwardly directed lip on the bottom of the panel with respect to the dimpling apparatus. A dimpling wheel is mounted in position to permit its outer periphery to frictionally engage and be driven by the flange as the extruded panel passes therethrough, and to allow one or more pin members projecting from the periphery of the dimple wheel to engage and punch, or die form, a portion of the plastic material in the area of the C-shaped bead out of its plane. The position of the pins can be adjusted to accurately control the height of the dimples. If desired, identifying indicia or the like may be provided on the periphery of the dimple wheel to die mark each sheet of the siding panel material.

BRIEF DESCRIPTION OF THE DRAWINGS

Other objects and advantages of the invention will become apparent from the detailed description contained hereinbelow, taken in conjunction with the drawings, in which.

DESCRIPTION OF THE PREFERRED EMBODIMENTS

Figure 4:
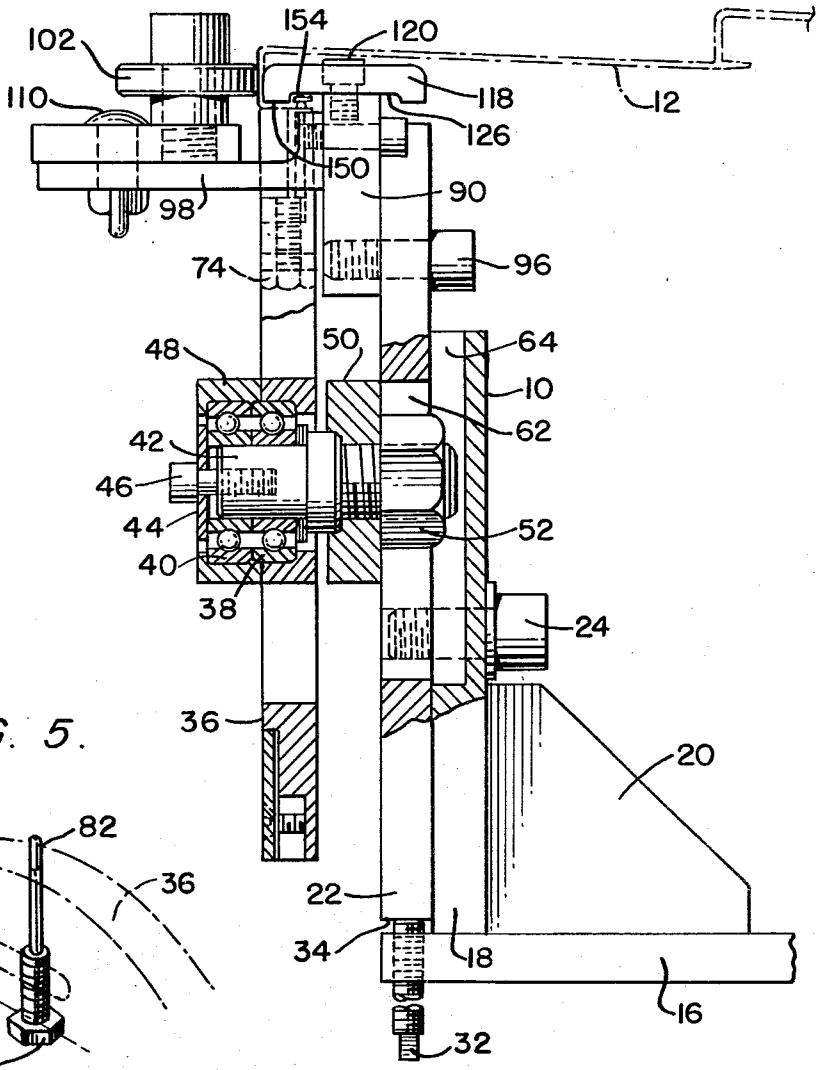
FIG. 4 is an enlarged sectional view taken on line 4—4 of FIG. 3.
Figure 1:
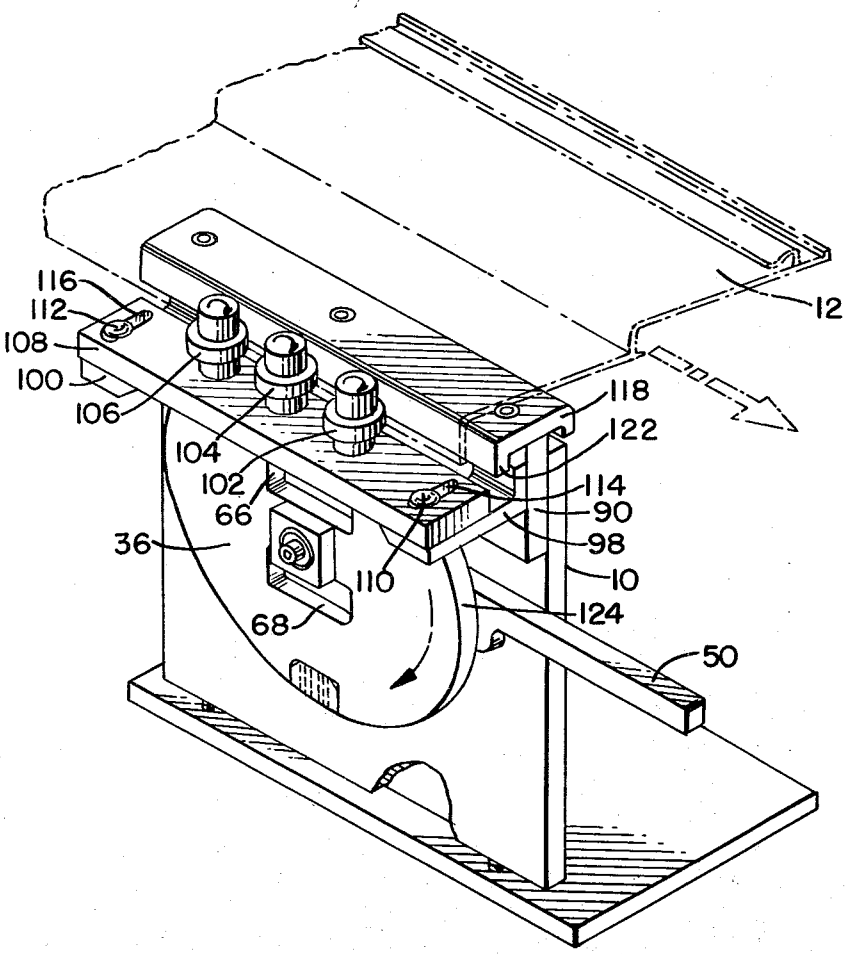
FIG. 1 is a perspective view of an apparatus suitable for use in forming the improved plastic building siding, with a siding panel being illustrated in the apparatus in broken line.
Figure 2:
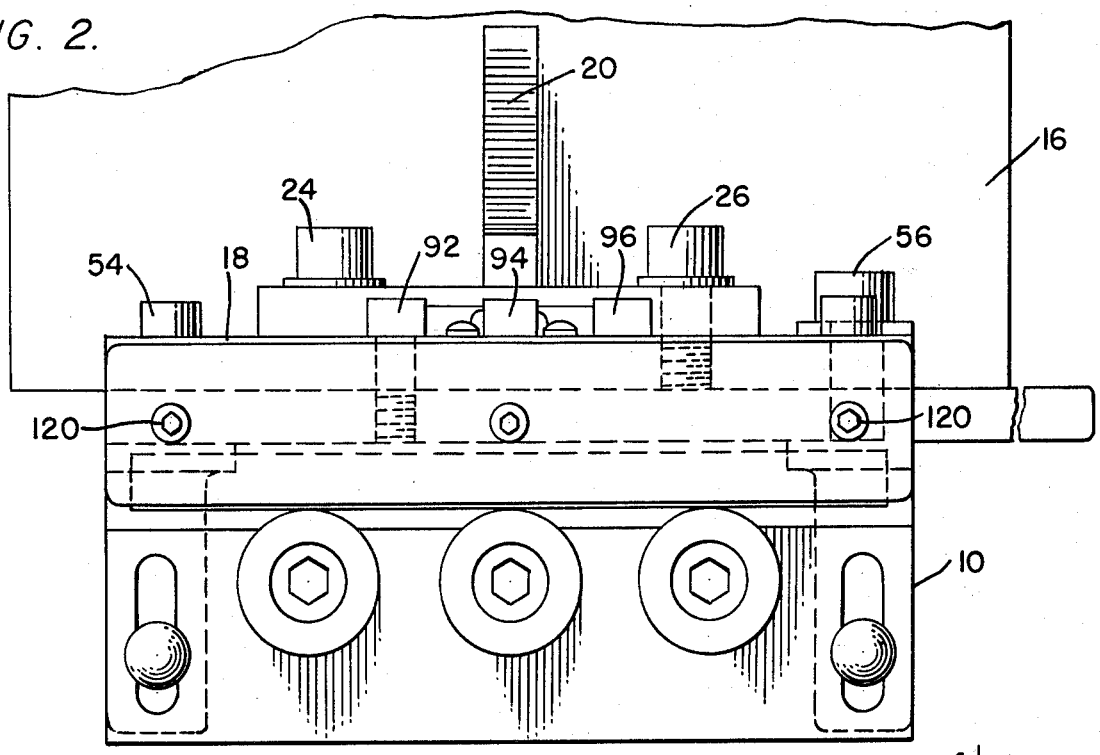
FIG. 2 is a top plan view of the apparatus shown in FIG. 1.
Figure 3:
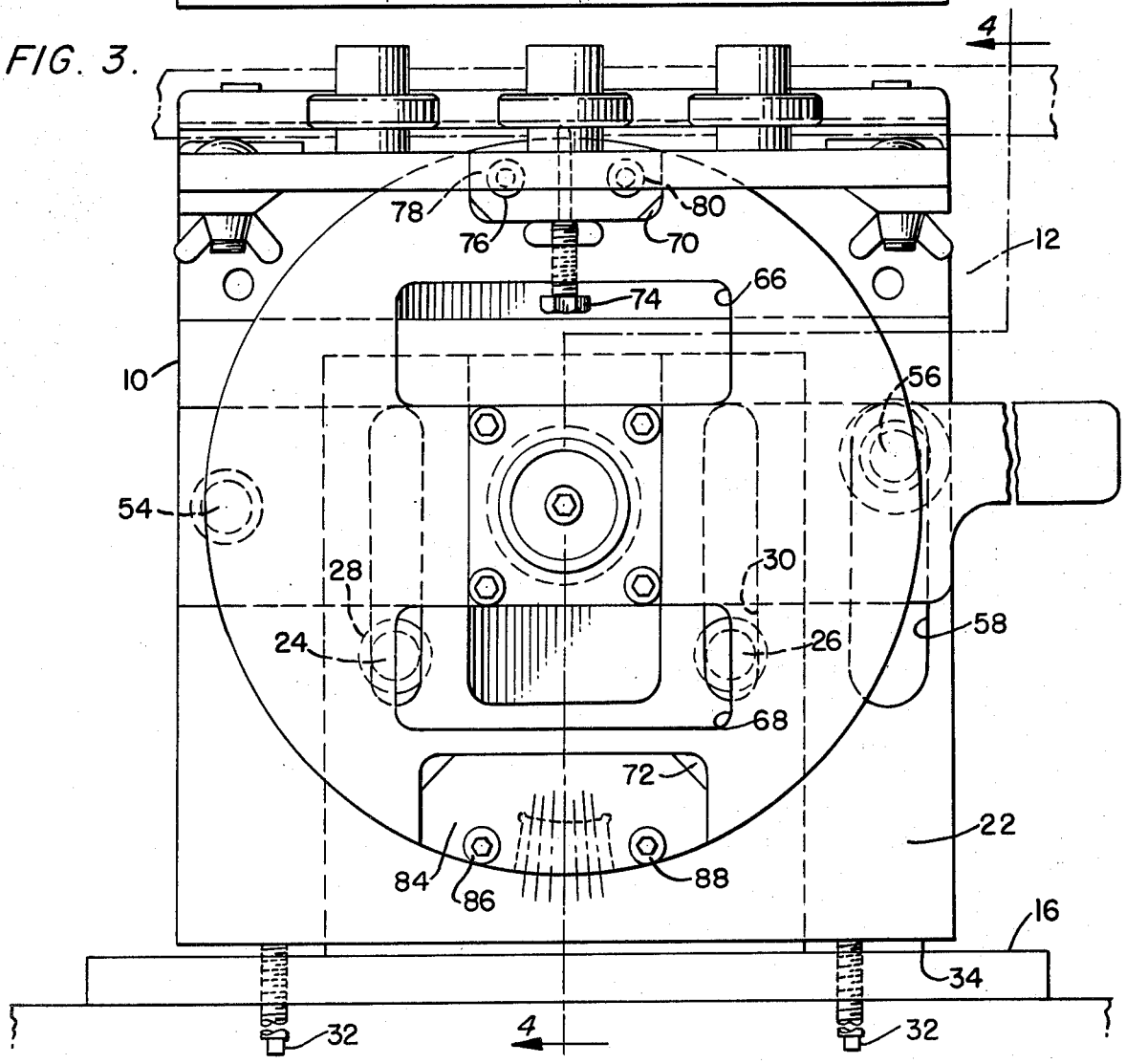
FIG. 3 is a front elevation view of the apparatus shown in FIG. 1.

Referring now to the drawings in detail, a dimpling apparatus suitable for use in practice of the invention is illustrated in FIGS. 1–5 and is designated generally by the reference numeral 10. Extruded plastic siding panels 12, illustrated in broken line in FIGS. 1, 3 and 4, are passed longitudinally through the dimpling apparatus 10 to have a plurality of dimples, or protrusions, 14 (see FIG. 6) formed therein as more fully described hereinbelow.

The dimpling apparatus 10 includes a support frame having a base 16 and a vertical support plate 18 rigidly welded to base 16 and reinforced as by a gusset 20. A dimpling wheel mounting plate 22 is mounted on plate 18 for vertically adjustable movement by a pair of bolts 24, 26 extending through vertical slots 28, 30, respectively, in the vertical plate 18. A pair of adjustment screws 33 extends through threaded openings in the base plate 16 to engage the bottom edge 34 of plate 22 to facilitate accurate vertical adjustment of the plate 22.

A dimpling wheel 36 is journaled, as by antifriction bearing assemblies 38, 40 for rotation about a horizontal axis on stub axle 42. A retaining washer 44 and locking bolt 46 retain bearing 38, 40 on the axle, and a hub 48 secured by suitable fasteners (not shown) on wheel 36 retains the dimpling wheel on the bearings.

Stub axle 42 is mounted on a lever 50, as by a locknut 52. Lever 50 has one end pivotally mounted, by a bolt 54, for limited pivotal movement about a horizontal axis. A locking bolt 56 extends through a vertical slot 58 in plate 22 and is threadably received in an opening (not shown) in lever 56 to retain the lever in vertically adjusted position. A large central opening 62 formed in plate 22, and a corresponding milled slot 64 in plate 18 permit vertical movement of the nut 52 and the projecting end of stub shaft 42.

A pair of generally rectangular openings 66, 68 is formed in and extends through dimpling wheel 36, and a pair of recesses 70, 72 is milled in one side face of the dimpling wheel at the peripheral portion thereof outboard of the openings 66, 68, respectively. A threaded opening extends radially from the openings 66 to the milled recess 70, and a cap screw 74 is threadably mounted in the opening with the head of the cap screw being accessable through the opening 66. A dimple pin support block 76 is mounted within the milled recess 70 by a pair of cap screws 78, 80. A radially extending dimple pin 82 is slidably mounted in a radial bore extending through the support block 76 and has its radially inner end resting on the radially outer end of cap screw 74.

Figure 5:
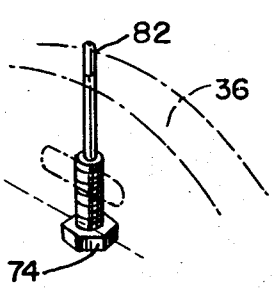
FIG. 5 is a fragmentary perspective view of a portion of the apparatus shown in FIGS. 1–4.

As illustrated schematically in FIG. 5, the extent to which the dimple pin 82 projects radially out past the periphery of dimple wheel 36 may be adjusted by adjusting the cap screw 74. Preferably pin 82 has a headed portion or other suitable means to retain the pin against falling out of the radial opening. Alternatively, the dimple pin may be frictionally retained in its radial bore, or spring means may be provided to normally urge the pin radially inward into contact with the cap screw 74.

A second mounting block 84 may be mounted in the recess 72, by suitable means such as the fasteners 86, 88 to retain marking dies or the like for imprinting identifying initia on the plastic siding panels. Alternatively, a second dimple pin may be used at this location.

A siding panel guide assembly is mounted on the top of support plate 22 and includes a spacer block 90 mounted adjacent the top of plate 22 by a plurality of cap screws 92, 94, 96. A pair of angle brackets 98, 100 are mounted one adjacent each end of spacer block 90, with the angle brackets projecting laterally therefrom. A plurality of guide rolls 102, 104, 106 are mounted for free rotation about vertical axes on a support beam 108, which, in turn, is adjustably supported on angle brackets 98, 100. Support beam 108 is mounted for adjustment toward and away from the vertical plane of dimpling wheel 36 by bolts 110, 112 extending through elongated slots 114, 116, respectively, in the ends of the support beam and through openings in the angle brackets 98, 100.

A siding panel support plate 118 is mounted on the top of spacer block 90, as by cap screws 120, with plate 118 projecting laterally from the spacer block to a position generally above dimpling wheel 36. A downwardly directed guide surface 122 on support plate 118 is spaced from the outer peripheral surface 124 of dimpler wheel 36 a distance corresponding generally to the thickness of a portion of the siding panel 12 which is to be passed between these two opposing surfaces so that, as the panel passes through the apparatus, frictional contact between the panel and surface 124 will rotate the dimpler wheel 36.

A recess 126 formed in the bottom surface of support plate 118 extends to a position overlaying a portion of the peripheral surface 124 so that the guide surface 120 has a width which is less than that of the peripheral surface of the dimple wheel. The recess 126 overlies the path of the dimple pin 82 so that, when the projecting end of pin 62 engages a portion of the siding panel 12, the portion engaged is projected into recess 126 to form a dimple by a punching, or die-forming operation.

Figure 6:
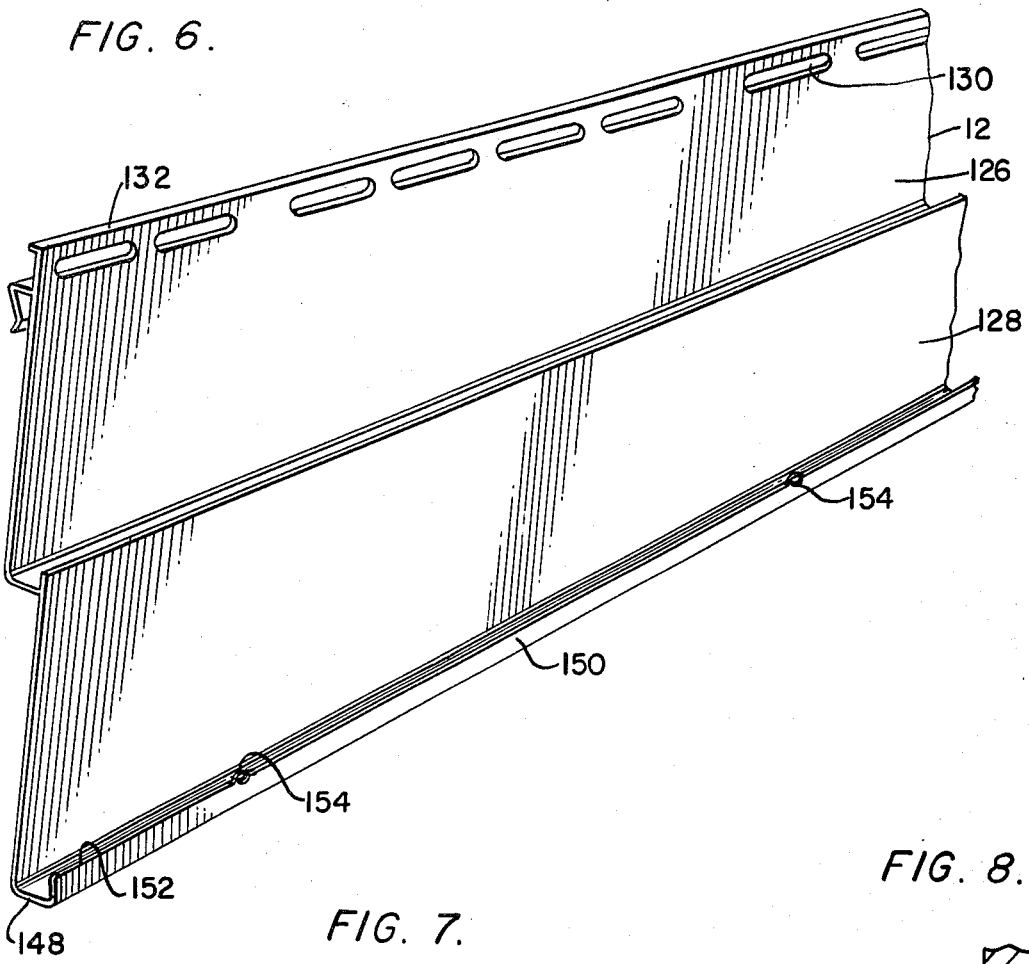
FIG. 6 is a perspective view of the rear face of a siding panel according to the present invention.
Figure 7:
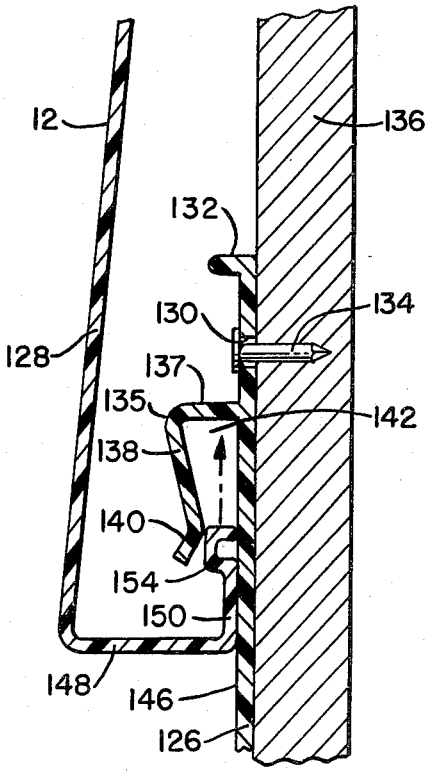
FIG. 7 is an enlarged, fragmentary sectional view showing the manner of mounting the siding panels onto a building wall.
Figure 8:
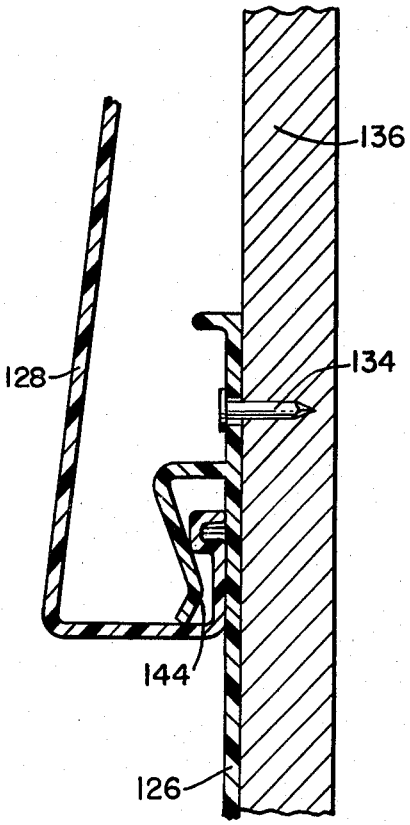
FIG. 8 is a view similar to FIG. 7 and showing the siding panel installed.

Referring now to FIGS. 6–8, it is seen that each siding panel 12 includes two face panel portions 126, 128 and is shaped to give the appearance of two weatherboard planks mounted in edge overlapping relation. A plurality of elongated nailing slots 130 is formed in a row adjacent the top edge of panel portion 126, and a short, outwardly directed flange 132 on the top edge portion of the panel stiffens this edge portion and provides a stop tending to prevent fastening nails 134 (see FIGS. 7 and 8) from being driven so far into the underlying sheeting material 136 as to prevent expansion movement.

A retaining clip flange 135 is integrally formed on the outer surface of each panel 12 at a position slightly below the row of nailing slots 130. The retaining clip flange includes a horizontal ledge 137 projecting outward from the surface of the panel portion 126, a downwardly and inwardly inclined leg portion 138 and a downwardly and outwardly inclined guide lip 140. The ledge 137, leg 138 and lip 140 cooperate with the outer surface of the panel portion 126 to define a downwardly open channel 142 extending the full length of the siding panel 12. The inner surfaces of leg 138 and lip 140 intersect at a line 144 which extends in fixed spaced relation to the outer surface 146 of panel portion 126, with this fixed spaced relation being substantially less than the spacing at the top of channel 142.

The bottom edge portion of each siding panel 12 is generally trough-shaped and is defined by an inwardly directed substantially horizontal flange portion 148 terminating in an upwardly locking lip 150. The siding panels 12 are initially extruded with a generally C-shaped bead portion 152 extending along the upper terminal edge of lip 150. This bead portion is dimensioned to provide a slight interference fit between the outer surface 146 of panel portion 126 and the surface 144 of the flange 135 when two of the siding panels 12 are being assembled together as shown in FIG. 7.

A plurality of dimples 154 are formed at spaced intervals along the length of bead 152, with these dimples having a transverse dimension, i.e., a dimension measured perpendicular to the plane of the locking lip 150, which is substantially greater than the corresponding dimension of the C-shaped bead. These dimples provide increased interference with the locking flange 135 when two panels are assembled together. The spacing of the beads along the length of the panels is important and in a preferred embodiment it has been found that one such dimple approximately every three feet will not increase the force required to snap the locking lip 150 into the bottom open end of the open channel 142 to the position shown in FIG. 8 sufficiently to materially effect assembly. This relatively small number of dimples will, however, provide sufficient holding force to support the weight of a single siding panel, and this greatly facilitates installation in that it enables a workman to have both hands free to reach for hammer, nails, or the like necessary to permanently attach the panel in position. At the same time, the panel can easily be removed, before nailing into place, by simply pulling down to snap the dimples from beneath the flange 135.

Referring again to FIGS. 1–5, it is seen that dimples 154 can be formed in the extruded siding panel strip as the strip is moved past the dimpling apparatus. In practice the strip 12 is extruded as a continuous length and drawn through the dimpling apparatus to have the dimples formed therein prior to being cut into standard lengths. The synthetic resin strip may still be in a softened condition although preferably the dimpling apparatus is spaced from the extruder a distance great enough so that the plastic material has hardened sufficiently so that the plastic will not be marked by contact with the apparatus.

By directing the strip 12 through the dimpling apparatus with flange 148 disposed between the vertical side face of support plate 118 and the guide wheels 102, 104, 106 and with the locking lip portion 150 between the peripheral surface 124 of the dimple wheel 36 and the downwardly directed surface 122, the lip is accurately positioned relative to dimpling apparatus. By adjusting the vertical position of the mounting lever 50, and thereby the dimpler wheel 36, sufficient frictional contact can be maintained between the surface of the locking strip 150 and the dimpler wheel 36 to rotate the dimpler wheel on its anti-friction bearings about its horizontal support axis. If desired, resilient means may be provided to urge the lever 50 upward with a predetermined force so that adjustment is not required for minor variations in thickness of the material being dimpled.

The transverse dimension of the surface 122 on support plate 118 is such that the C-shaped bead 152 projects upwardly into the recess 126 in alignment with the projecting end portion of the dimpler pin 82. As the pin contacts the C-shaped bead, a portion of the plastic material is drawn, or die-shaped upwardly against the bottom surface of the channel 126. Thus, the dimension of the dimple can be accurately controlled so that tolerances on the dimension of the C-shaped bead, and of the clearance between the outer surface 146 of the panel and the innermost surface portion 144 of the flange 135 can be reduced without producing an excessively loose or tight clip joint.

From the above, it is believed apparent that the method and apparatus of the present invention may be employed to produce an improved plastic siding panel. Further, installation of the siding panels is greatly facilitated and the manufacturing costs may be reduced as a result of reduced tolerance standards required in the extrusion process.

It should be understood that this invention may be embodied in other specific forms without departing from its spirit or essential characteristics. Accordingly, the present embodiments are to be considered in all respects as illustrative and not restrictive, the scope of the invention being indicated by the appended claims rather than by the foregoing description, and all changes which come within the meaning and range of equivalency of the claims are intended to be embraced therein.

I claim:

1. In a building siding panel extruded from a synthetic resin material and being adapted for mounting in generally horizontal overlaping relation with similar panels on a building wall to simulate weatherboard siding, the siding panel including a nailing strip having a plurality of elongated slot-like openings extending along its edge, a locking flange integrally formed on and projecting outwardly from and downwardly along the outer surface of the panel adjacent the nailing strip and an upwardly directing locking lip integrally formed on and extending along its bottom edge, the locking flange cooperating with the outer surface of the panel to define a downwardly open locking channel having a relatively narrow opening adjacent its open bottom and being substantially wider adjacent its upper portion, and the upwardly directed locking strip being dimensioned to fit within the narrow open bottom of the locking channel, the improvement comprising, an elongated bead integrally formed on and extending longitudinally of said upwardly directed locking lip adjacent its uppermost edge, and a plurality of dimples formed in said bead at spaced intervals along its length, said dimples having a dimension measured in a direction generally perpendicular to the plane of the lip which is substantially greater than the width of the narrow opening of said locking channel but less than the corresponding dimension of the locking channel adjacent its upper end.

2. The building siding panels according to claim 1 wherein said elongated bead is in the form of a substantially C-shaped channel, and wherein the thickness of the plastic material forming the channel is substantially equal to the thickness of the material forming said locking lip.

3. The building siding panels defined in claim 2 wherein said dimples are formed in a punching operation from the material initially forming said C-shaped channel.

* * * * *